United States Patent [10]

Baldwin

[11] Patent Number: 4,480,701

[45] Date of Patent: Nov. 6, 1984

[54] LOCATING THE RELATIVE TRAJECTORY OF A RELIEF WELL DRILLED TO KILL A BLOWOUT WELL

[75] Inventor: Willett Baldwin, Dallas, Tex.

[73] Assignee: Mobil Oil Corporation, New York, N.Y.

[21] Appl. No.: 415,868

[22] Filed: Sep. 8, 1982

[51] Int. Cl.[3] ..... E21B 47/02

[52] U.S. Cl. ..... 175/45; 175/61

[58] Field of Search ..... 175/45, 61, 40, 57; 166/363, 364

[56] References Cited

U.S. PATENT DOCUMENTS 4,220,214 9/1980 Benoit ..... 175/61

4,224,989 9/1980 Blount ..... 175/61 X

OTHER PUBLICATIONS

"Development and Future Trend of Controlled Directional Drilling", *Tomorrow's Tools Today*, M. E. Montrose, May 1939, pp. 2, 3, 6.

*Primary Examiner*—Stephen J. Novosad

*Assistant Examiner*—Michael Starinsky

*Attorney, Agent, or Firm*—Alexander J. McKillop; Michael G. Gilman; Charles J. Speciale

[57] ABSTRACT

In the drilling of a relief well to kill a blowout well, the relative trajectory of the relief well with respect to the blowout well is determined by selecting correlation points at which the relief well and the blowout well intersect the same subsurface formation. A resistivity log of the relief well indicates the correlation points with the blowout well. The location of the relative trajectories is obtained from the differences in depths of the formations and the correlation points.

11 Claims, 5 Drawing Figures

LOCATING THE RELATIVE TRAJECTORY OF A RELIEF WELL DRILLED TO KILL A BLOWOUT WELL

BACKGROUND OF THE INVENTION

This invention relates to the drilling of a relief well and more particularly, to locating the relative trajectory of said relief well with respect to the blowout well.

Typically, wells are drilled into the earth's crust to desired subsurface oil-and/or gas-bearing formations. A drilling mud is pumped downwardly through a rotating drill string within the well, through the drill bit at the bottom of the drill string, and thence upwardly to the surface of the well through the annulus surrounding the drill string. A "blowout" may occur when the well penetrates a high pressure gas-producing formation due to a number of circumstances. Gas from the high pressure formation may enter the well and mix with the drilling mud so that its density is reduced by gas occlusion, thus reducing the hydrostatic head on the well to a value less than that of the formation pressure. A blowout may also occur during removal of the drill string from the well. Displacement of the drilling mud by the drill string may result in a decrease in the liquid level within the well with, again, a decrease in the hydrostatic head at the level of the high pressure formation.

When a blowout occurs, a number of remedial procedures are available to kill the blowout and bring the well under control. One technique involves the drilling of a relief well into a subsurface formation near the blowout well. Communication between the relief well and blowout well is established and fluids are then pumped down the relief well and into the blowout well in an attempt to impose a sufficient hydrostatic head to block the flow of gas from the formation into the well. Communication between the wells may be established through the high pressure sand which caused the blowout or through a separate permeable zone penetrated by both the blowout and relief wells. U.S. Pat. No. 4,224,989 Blount describes the killing of a blowout well in this manner.

A problem arises in drilling the relief well into close proximity with the blowout well in a formation in which communication between the relief well and the blowout well can be established. Techniques of directional drilling are known and described, for example, in U.S. Pat. No. 4,220,214—Benoit. Instruments are available for obtaining precise surveys of the trajectories of the well. U.S. Pat. No. 3,229,375—Crake, et al is an example. It is usually quite difficult to drill the relief well to close on the blowout well based solely on survey measurements from the wells.

Magnetic ranging equipment such as that described in U.S. Pat. No. 4,072,200 has been successfully used to track the trajectory of the blowout well with respect to the relief well. However, this technique is useful only when the blowout well has casing or drill pipe in the hole. Frequently, magnetic ranging data cannot be obtained because the interval of interest has no iron in the hole.

Acoustic techniques are sometimes used to track the trajectory of one well with respect to another. U.S. Pat. No. 3,722,605—Isham shows an example of an acoustic logging instrument used for this purpose. These tools are not suitable for use where the wells are widely spaced or in subsurface formations, which are not conducive to accoustic logging.

It is an object of the present invention to accurately establish the relative trajectory of a relief well with respect to a blowout well.

SUMMARY OF THE INVENTION

In accordance with the present invention, the relief well is traversed with a logging tool to produce a log of the depths of subsurface formations in the relief well. From this log, the correlation points at which the relief well intersects the same formations as the well are selected. The depths of these formations in the blowout well and in the relief well establish the relative trajectories of the two wells. Once the relative trajectories of the two wells have been determined, the relief well can be drilled in a direction indicated by these relative trajectories toward intersection with the blowout well.

The known depths of the formations in the blowout well are located with respect to the correlation points. Locating the relative trajectories of the relief well and the blowout well can be carried out graphically or by computation. In a graphic implementation of the invention, the differences between the known depths of the formations in the blowout well are determined. For successively deeper depths, an arc proportional to each difference is struck. The intersection of each successive arc with a line extending from the corresponding correlation point in the relief well is plotted.

In practicing the invention, the relief well may be surveyed to obtain directional measurements of the locations of the correlation points. Then, the trajectory of the blowout well can be located with respect to these directional measurements of the correlation points.

Further in accordance with the invention, a dipmeter log of the relief well may be used to determine the dip of the subsurface formations. Then, actual distances between the relief well and the blowout well can be determined.

The foregoing and other objects, features and advantages of the invention will be better understood from the following more detailed description and appended claims.

SHORT DESCRIPTION OF THE DRAWINGS

DESCRIPTION OF THE PREFERRED EMBODIMENT

Figure 1:
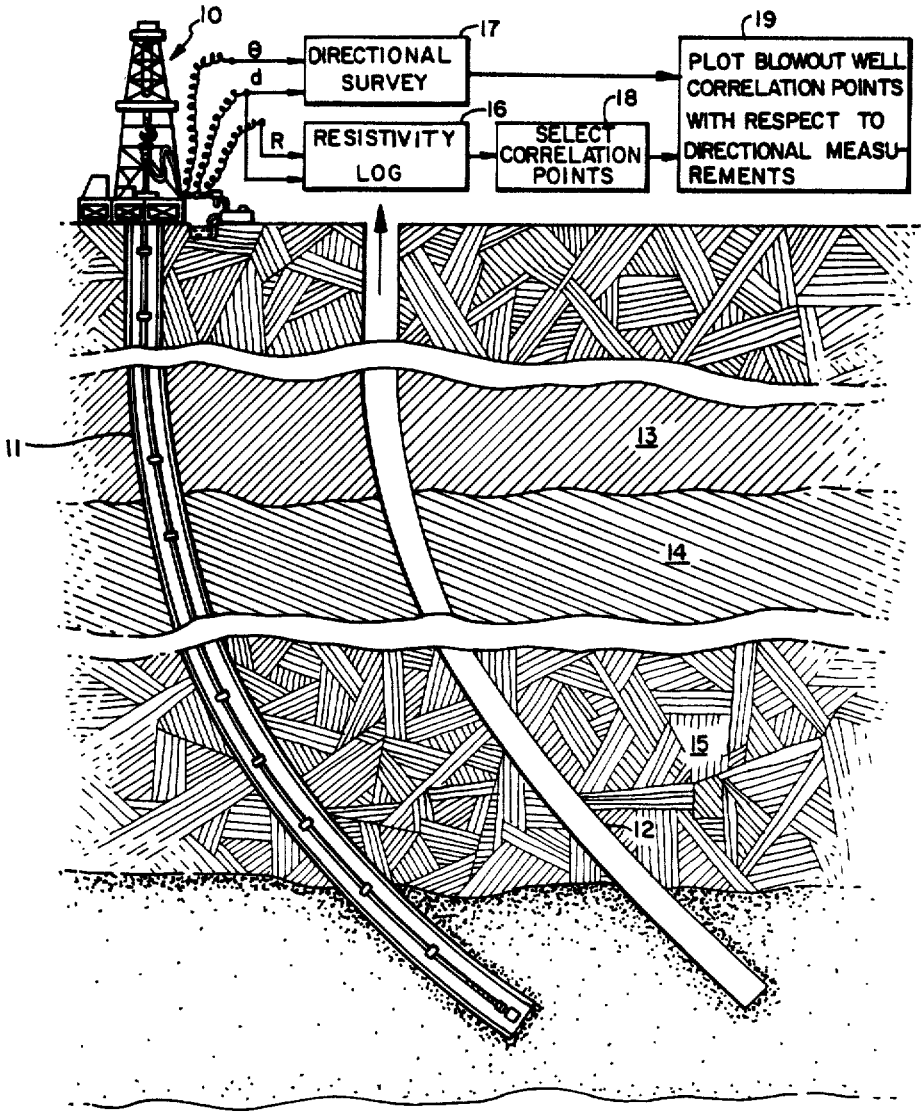
FIG. 1 depicts the drilling of a relief well adjacent to a blowout well.

Referring to FIG. 1, a drilling rig 10 is used to drill a relief well 11 on a trajectory which tracks the blowout well 12. The blowout well 12 penetrates subsurface formations such as those indicated at 13, 14 and 15. Normally, the depth of these formations is known from prior logging operations or from cores obtained during the drilling of the well 12. In accordance with the present invention, the relief well 11 is logged to determine the correlation points between formations traversed by wells 11 and 12. As indicated in FIG. 1, a logging while drilling procedure can be performed to obtain a resistivity log, indicated at 16. A directional survey, indicated at 17, is similarly produced while drilling to obtain measurements of well inclination $\theta$ and depth d. Correlation points on the resistivity log 16 are selected as indicated at 18. The blowout well correlation points are plotted with respect to the directional measurements as indicated at 19.

Figure 2:
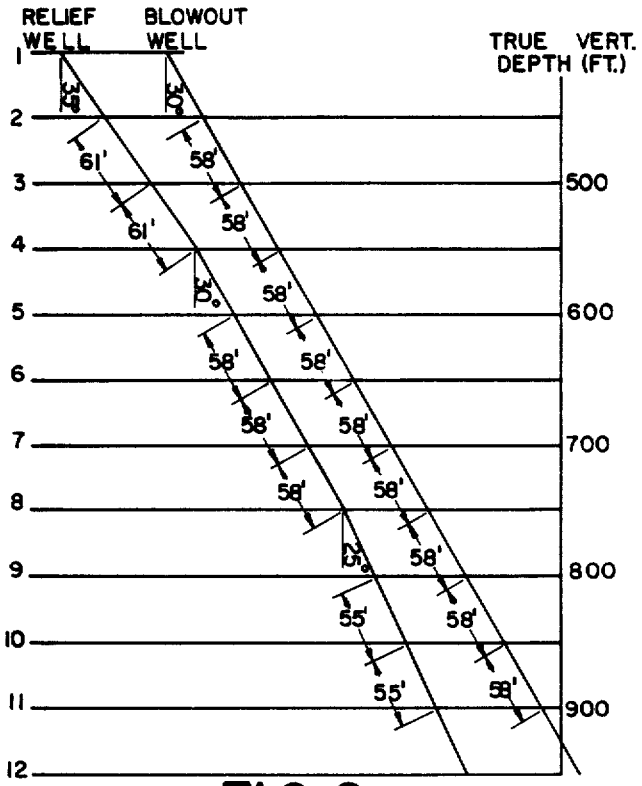
FIG. 2 depicts a plot of the correlation points in a relief well with respect to known depths in a blowout well.

The foregoing will be better understood with reference to the performance of several examples of the invention. FIG. 2 depicts the plots of a blowout well and a relief well which are in practically the same vertical plane. That is, both holes have the same azimuth. The relief well is under the blowout well. The blowout well has a constant hole inclination angle of 30°. The relief well has an inclination of 35°. Deeper, its hole inclination changes to 30°. Deeper still, the hole inclination is 25°. Arbitrary level formation tops (correlation points) are shown and are numbered 1 through 12. The plot in FIG. 2 shows the following. When the difference between the correlation points in the relief well is greater than in the blowout well, the hole inclination of the relief well is greater than that of the blowout well.

If the difference between correlation points in the relief well is less than in the blowout well, the hole inclination of the relief well is less than that of the blowout well.

If the difference between the correlation points in the blowout well and relief well is equal, the two holes are parallel.

Where the difference in inclination between the two holes is not known, it can be estimated graphically by use of the foregoing properties of the difference between correlation points.

The three assumptions made in this hypothetical case are (1) that the relief well has the same azimuth as the wild well, (2) that the relief well is directly under (or over) the wild well, and (3) that the formation dip is zero. The first assumption should often be closely approximated in real cases, since when closing on a wild well an effort is often made to approach at a very small relative angle. The second assumption is not required for determination of relative hole inclination, i.e. both holes do not have to be in the same vertical plane. It is included here for clarity of illustration. The assumption of zero dip is also made for clarity of illustration. If the formation dip does not change between the wells, as is the case for closely spaced wells, this method of measuring relative hole inclination is still valid.

Figures 3, 3A:
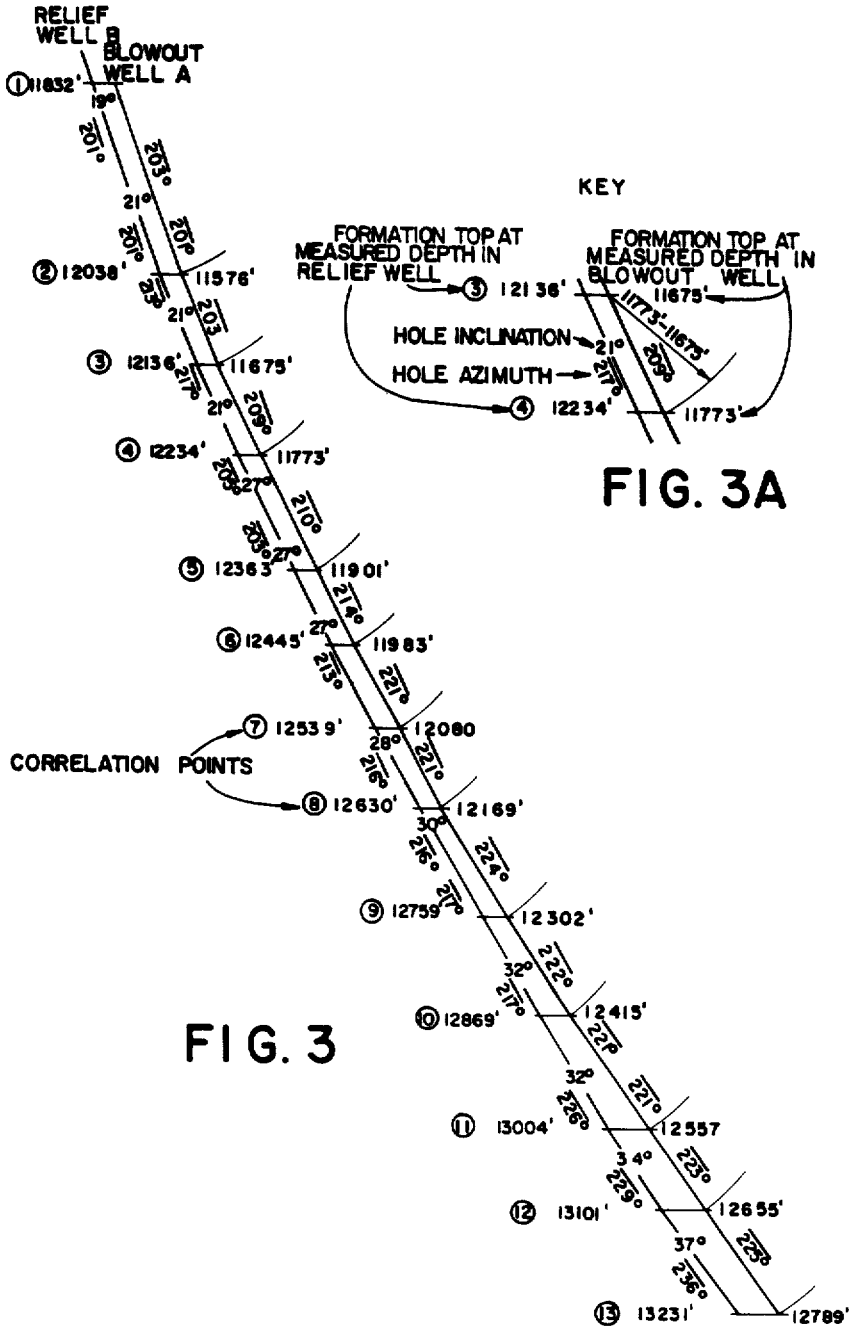
FIG. 3 shows another example in which the trajectory of the relief well was plotted graphically using measurements from a directional survey.
FIG. 3A is a key useful in understanding FIG. 3.

As a practical example, consider FIG. 3. The left well is a relief well (B), and the other is a blowout well (A). The azimuth of each hole changed slightly versus depth, but both holes were practically in the same plane at comparable depths. It is important to note that both wells do not have to be in a vertical plane—just some plane. From a practical standpoint, as long as both holes' directions are within ±15°, the results will be close enough. The smaller the difference, the better the results.

A complete continuous directional survey of the wild well is not necessary. Quite often single shot surveys are run before a bit change and the hole deviation and direction (azimuth) are obtained. Also, if a dipmeter is run in the wild well, it will suffice.

From other measurements, it was determined that well B was under well A as magnetic ranging readings were taken during the drilling of well B.

For this example, the complete track of well B was constructed graphically using the conventional hole measurements from the directional survey. An arbitrary horizontal distance between the two wells was assumed at formation top 1, and the track for well A was started at formation top 1.

Construction of this track for well A was done as follows. A horizontal line was drawn between the two tracks simulating formation top 1. An arc was drawn from the point where the horizontal line 1 intersected well A. Its radius was equal to the measured distance in well A between formation tops 1 and 2. The arc's intersection with a horizontal line through formation top 2 was made the next position of well A. Proceeding downward, the track for well A was constructed using only arcs whose radii were equal to the distance between tops and the horizontal projection intersections.

The correlation points were obtained from short normal resitivity logs. As an example, SCHLUMBERGER LOG INTERPRETATION, Vol. 1—Principles, 1972, pp. 13–16 describes resistivity logging.

The resultant track for well A compares well with single shots taken when drilled. This method indicates the closest point between the two holes is near formation top 8.

The tracks confirm that the directional drilling of the relief well was quite adequate as the objective was to close to well A when the sand at total depth was reached.

A listing of the correlation points used is given in Table 1. Only 13 of the 32 correlation points found on the logs were used.

TABLE 1

DEPTHS OF FORMATION TOPS AND/OR CORRELATION POINTS (1 THRU 13)

| FEET | | | |
|---|---|---|---|
| WELL A | | WELL B | |
| MEASURED DEPTHS | DIFFERENCE | MEASURED DEPTHS | DIFFERENCE |
| 1. 11372 | | 1. 11832 | |
| | 204 | | 206 |
| 2. 11576 | | 2. 12038 | |
| | 99 | | 98 |
| 3. 11675 | | 3. 12136 | |
| | 98 | | 98 |
| 4. 11773 | | 4. 12234 | |
| | 128 | | 129 |
| 5. 11901 | | 5. 12363 | |
| | 82 | | 82 |
| 6. 11983 | | 6. 12445 | |
| | 97 | | 94 |
| 7. 12080 | | 7. 12539 | |
| | 89 | | 91 |
| 8. 12169 | | 8. 12630 | |
| | 133 | | 129 |
| 9. 12302 | | 9. 12759 | |
| | 113 | | 110 |
| 10. 12415 | | 10. 12869 | |
| | 142 | | 135 |
| 11. 12557 | | 11. 13004 | |
| | 98 | | 97 |
| 12. 12655 | | 12. 13101 | |
| | 134 | | 130 |
| 13. 12789 | | 13. 13231 | |

Figure 4:
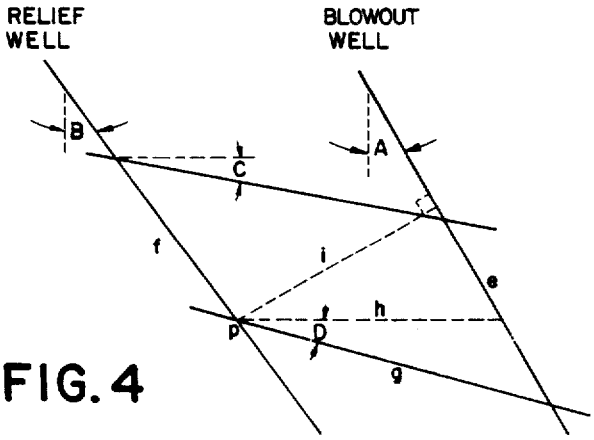
FIG. 4 depicts a computation of the distances between the relief well and the blowout well.

As an alternate to the graphical technique described above, the distance between the relief well and the blowout well can be determined from the differences between the correlation points, the differences in depths of the formations, and the directional survey which must include the dip of each formation. Commonly, a dipmeter log can be run in the relief well to obtain values of dip for each of the formations. With this information, the distance from the correlation point p in the relief well to the blowout well can be determined as depicted in FIG. 4. The differences e and F between formation, and correlation points, respectively are known. The manner of determining the distance i is as follows.

$$g = e - \left[ \frac{f \cos (B + C)}{\cos (A + C)} \right] \times \frac{\sin (90 + A + C)}{\sin (D - C)}$$

$$h = g \frac{\sin (90 - A - D)}{\sin (90 + A)}$$

$$i = g \cos (A + D)$$

In the foregoing, angles A and B are hole inclinations from the directional survey. Angles C and D are dips from dipmeter data. Lengths e and f are correlations from one well to the other; h is the horizontal distance from the wells at point p. A graphics solution is possible also to specify the length i.

If both holes are not in approximately the same plane, then for the first case (FIG. 3), the differences in Table 1, can be adjusted by using the angular difference between the two azimuths of the holes at the same depth. For FIG. 4, the lengths e or f can be adjusted the same way.

While particular embodiments of the invention have been shown and described, various modifications are within the true spirit and scope of the invention. The appended claims are, therefore, intended to cover all such modifications.

What is claimed is:

1. A method of locating a relative trajectory of a relief well with respect to a blowout well intersecting subsurface formations at known depths comprising the steps of:

determining at what depths said blowout well intersects said subsurface formations;

logging said relief well for some measurable parameter which indicates said subsurface formations to produce a measured parameter log indicating where said relief well intersects said subsurface formations;

selecting from said log correlation points at which said relief well and said blowout well intersect the same subsurface formations; and locating the relative trajectory of said relief well with respect to said blowout well from bore hole length differences between formation intersection depths in said relief well and blowout well taken between the same correlation points.

2. The method recited in claim 1 further comprising:

drilling said relief well in a direction indicated by said relative trajectories toward intersection with said blowout well.

3. The method recited in claim 1 wherein the step of locating includes:

determining the differences between the known depths of said subsurface formation intersections in said blowout well.

4. The method recited in claim 3 further comprising tracking said blowout well by the steps of:

(a) picking a subsurface intersection correlation point for said relief well and extending a line therefrom to a corresponding formation first intersection point in said blowout well;

(b) drawing an arc using said first intersection point in said blowout well as a center and having a radius determined by a difference in said blowout well betweeen said first intersection point and a next-in-depth subsurface formation intersection;

(c) determining the intersection of said arc with a line extending from the next-in-depth subsurface intersection point for said relief well; and (d) plotting a path of said blowout well from the first subsurface formation intersection point in step (a) to the arc intersection point in step (c).

5. The method recited in claim 4 further comprising the step of (e) using said arc intersection point in step (c) as a new center and as said first intersection point and repeating steps (b) through (d).

6. The method recited in claim 5 wherein said formations have substantially no dip and wherein said line extending from the corresponding correlation point is a horizontal line.

7. The method recited in claim 5 wherein said formations are dipping and wherein said line extending from the corresponding correlation point has the angle of the dip of the formation at each correlation point.

8. The method recited in claim 1 further comprising:

surveying said relief well to obtain directional measurements of the locations of said correlation points in said relief well.

9. The method recited in claim 8 wherein the step of locating the relative trajectories of said relief well and said blowout well includes plotting the known depths of said formations in said blowout well with respect to said directional measurements of said correlation points.

10. The method recited in claim 8 wherein the step of surveying said relief well includes measuring the dip of said subsurface formations.

11. The method recited in claim 10 wherein the step of locating the relative trajectories of said relief well and said blowout well includes:

determining the distance from each of said correlation points to said blowout well from the differences in depths between said formation intersections in said blowout well, the differences in depth of said correlation points, the dip of said formations, and the inclination of said well.

* * * * *